US012181159B2

(12) United States Patent
Suenaga

(10) Patent No.: US 12,181,159 B2
(45) Date of Patent: Dec. 31, 2024

(54) HEATING COOKING DEVICE

(71) Applicant: SHARP KABUSHIKI KAISHA, Sakai (JP)

(72) Inventor: Hiromi Suenaga, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 1070 days.

(21) Appl. No.: 17/105,989

(22) Filed: Nov. 27, 2020

(65) Prior Publication Data

US 2021/0199305 A1 Jul. 1, 2021

(30) Foreign Application Priority Data

Dec. 26, 2019 (JP) ..... 2019-236386

(51) Int. Cl.
*F24C 7/06* (2006.01)
*F24C 7/02* (2006.01)
*F24C 15/12* (2006.01)

(52) U.S. Cl.
CPC ..... *F24C 7/06* (2013.01); *F24C 7/02* (2013.01); *F24C 15/12* (2013.01)

(58) Field of Classification Search
CPC ..... F24C 15/12; F24C 7/02; F24C 7/06
USPC ..... 219/391
See application file for complete search history.

(56) References Cited

U.S. PATENT DOCUMENTS 5,534,681 A * 7/1996 Hwang ..... H05B 6/6482 219/404
2013/0019852 A1* 1/2013 Yu ..... F24C 7/06 126/19 R

FOREIGN PATENT DOCUMENTS

| | | | | |
|---|---|---|---|---|
| CA | 3037788 | A1 * | 5/2020 | ..... F24C 15/102 |
| CN | 625032 | A5 * | 9/1977 | ..... F24C 7/06 |
| JP | S60-30908 | U | 3/1985 | |
| JP | S60-159903 | U | 10/1985 | |
| JP | S61-284090 | A | 12/1986 | |
| JP | 2001-082745 | A | 3/2001 | |

* cited by examiner

*Primary Examiner* — Steven W Crabb
*Assistant Examiner* — Ket D Dang
(74) *Attorney, Agent, or Firm* — ScienBiziP, P.C.

(57) ABSTRACT

The heating cooking device includes a heating cooking chamber, a heater, and a support portion. The heating cooking chamber includes a top wall, and accommodates an object to be heated. The heater heats the object to be heated. The support portion supports a part of the heater. The heating cooking chamber further includes a first side wall and a second side wall facing the first side wall. The heater extends from the first side wall toward the second side wall, folds back from a side of the second side wall, and extends to the first side wall. The heater includes a first base end portion and a second base end portion. The first base end portion and the second base end portion are disposed on the first side wall. A position of the first base end portion along a vertical direction and a position of the second base end portion along the vertical direction are different.

4 Claims, 16 Drawing Sheets

HEATING COOKING DEVICE

CROSS-REFERENCE TO RELATED APPLICATIONS

This application claims the benefit of priority to Japanese Patent Application Number 2019-236386 filed on Dec. 26, 2019. The entire contents of the above-identified application are hereby incorporated by reference.

BACKGROUND

Technical Field

The disclosure relates to a heating cooking device.

A high frequency heating device described in JP 2001-82745 A includes a heating chamber, a high frequency power supply, and a sheathed heater. The heating chamber accommodates an object to be heated. The high frequency power supply supplies high frequency to the heating chamber. The sheathed heater is disposed on an upper portion in the heating chamber. The sheathed heater includes an end portion derived to the outside of the heating chamber and the end portion coupled to a control device. The sheathed heater is attached to a side wall of one of a plurality of side walls of the heating chamber by a plate-like attaching fitting.

SUMMARY

However, in a sheathed heater of a heating cooking device such as the high frequency heating device described in JP 2001-82745 A, one end portion is fixed by a plate-like attaching fitting, but the other end portion is not fixed. Therefore, the sheathed heater easily oscillates. The sheathed heater oscillates, and thus the durability of the sheathed heater is reduced.

The disclosure is made in view of the problem described above, and an object thereof is to provide a heating cooking device capable of suppressing an oscillation of a heater.

According to one aspect of the disclosure, a heating cooking device includes a heating cooking chamber, a heater, and a support portion. The heating cooking chamber includes a top wall and is configured to accommodate an object to be heated. The heater is configured to heat the object to be heated. The support portion is disposed on the top wall, and configured to support a part of the heater. The heating cooking chamber further includes a first side wall and a second side wall facing the first side wall. The heater extends from the first side wall toward the second side wall, folds back from a side of the second side wall, and extends to the first side wall. The heater includes a first base end portion and a second base end portion separated from each other. The first base end portion and the second base end portion are disposed on the first side wall. A position of the first base end portion along a vertical direction and a position of the second base end portion along the vertical direction are different.

A heating cooking device according to the disclosure can suppress an oscillation of a heater.

BRIEF DESCRIPTION OF DRAWINGS

The disclosure will be described with reference to the accompanying drawings, wherein like numbers reference like elements.

DESCRIPTION OF EMBODIMENTS

Figure 1:
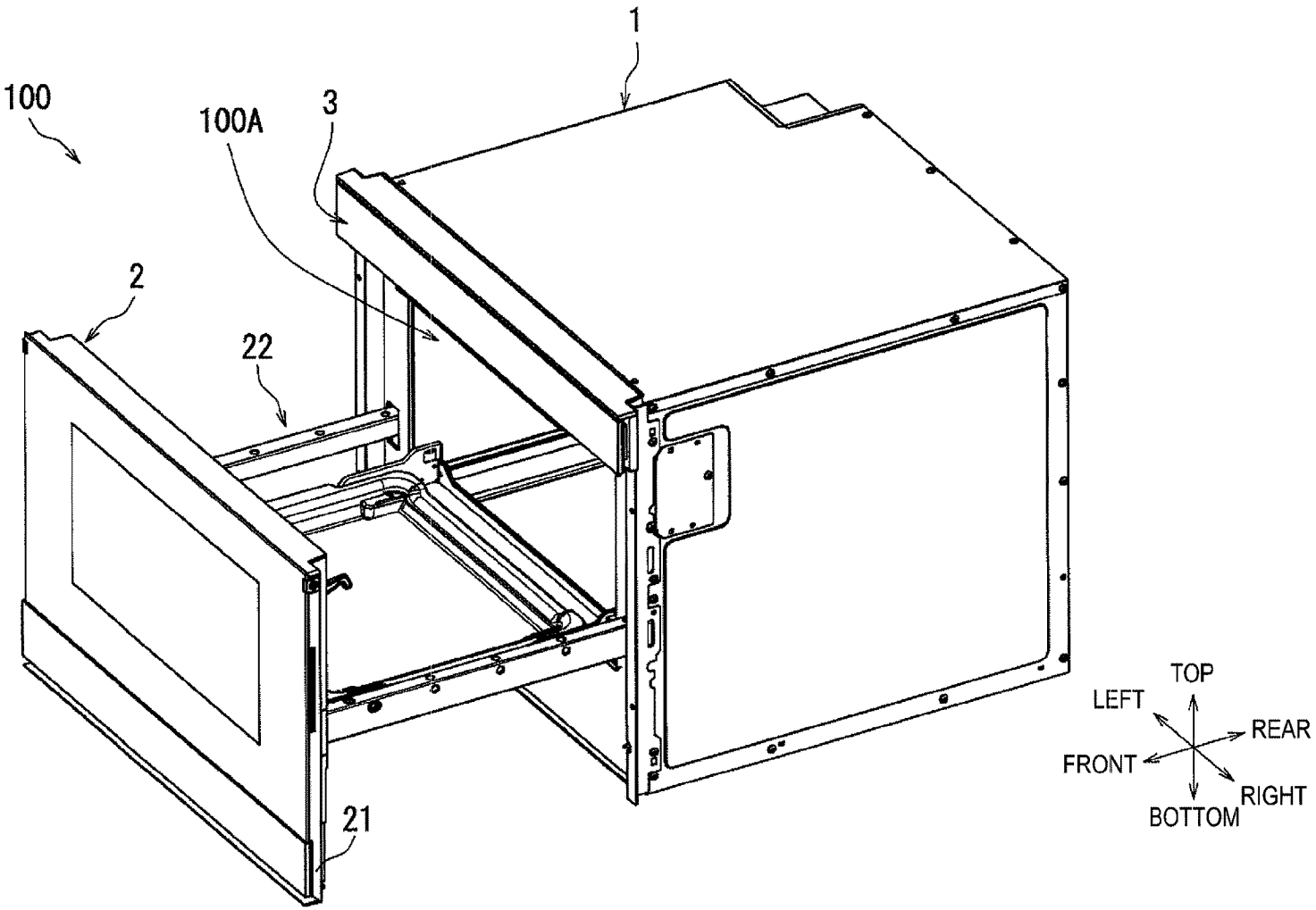
FIG. 1 is a perspective view illustrating an appearance of a pull-out heating cooking appliance according to an embodiment of the disclosure.

Embodiments of the disclosure will be described hereinafter with reference to the drawings. Note that the same or corresponding portion is denoted by the same reference sign in the drawings, and description thereof will not be repeated.

Figure 2:
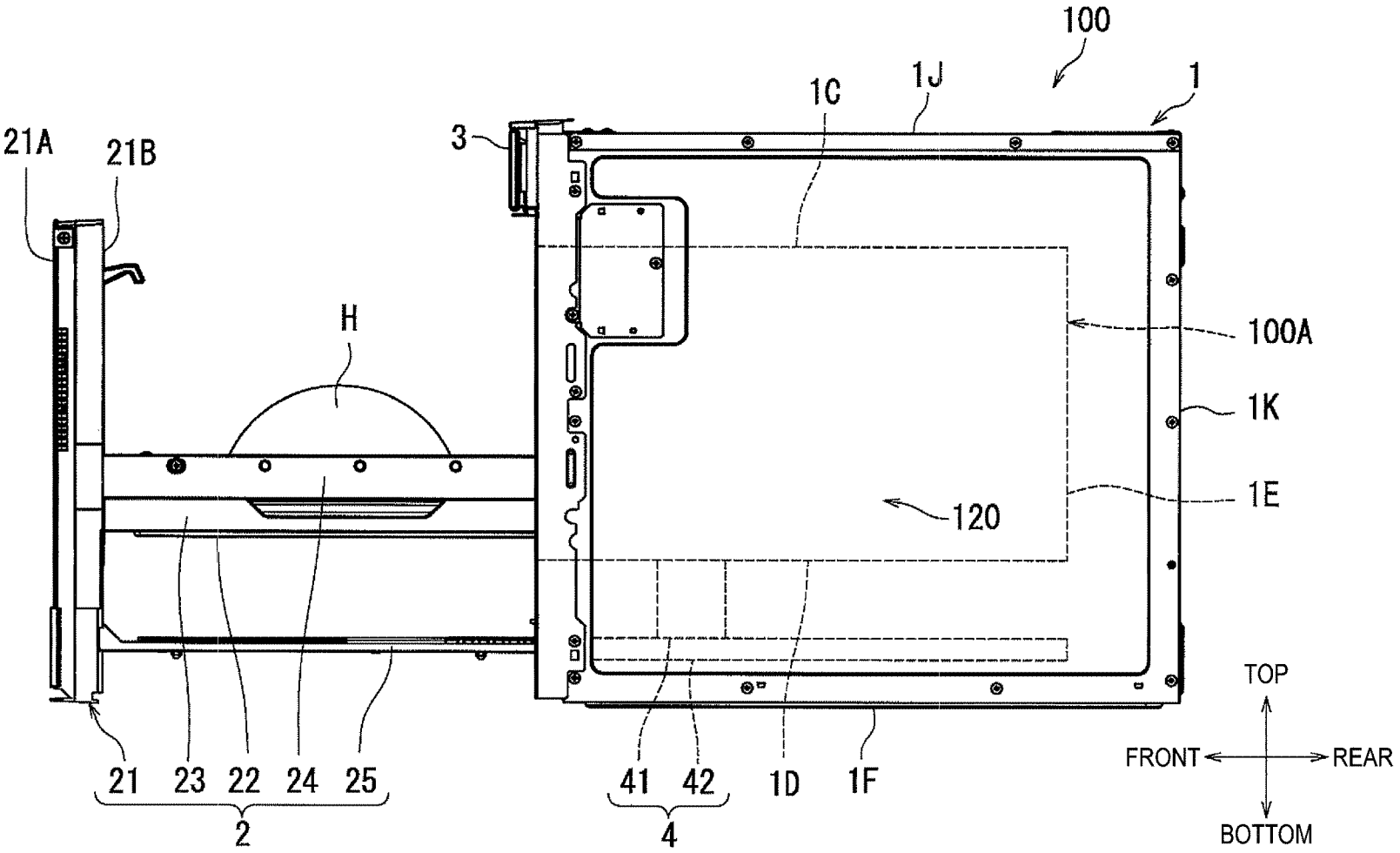
FIG. 2 is a right side view illustrating the pull-out heating cooking appliance according to the present embodiment.
Figure 3:
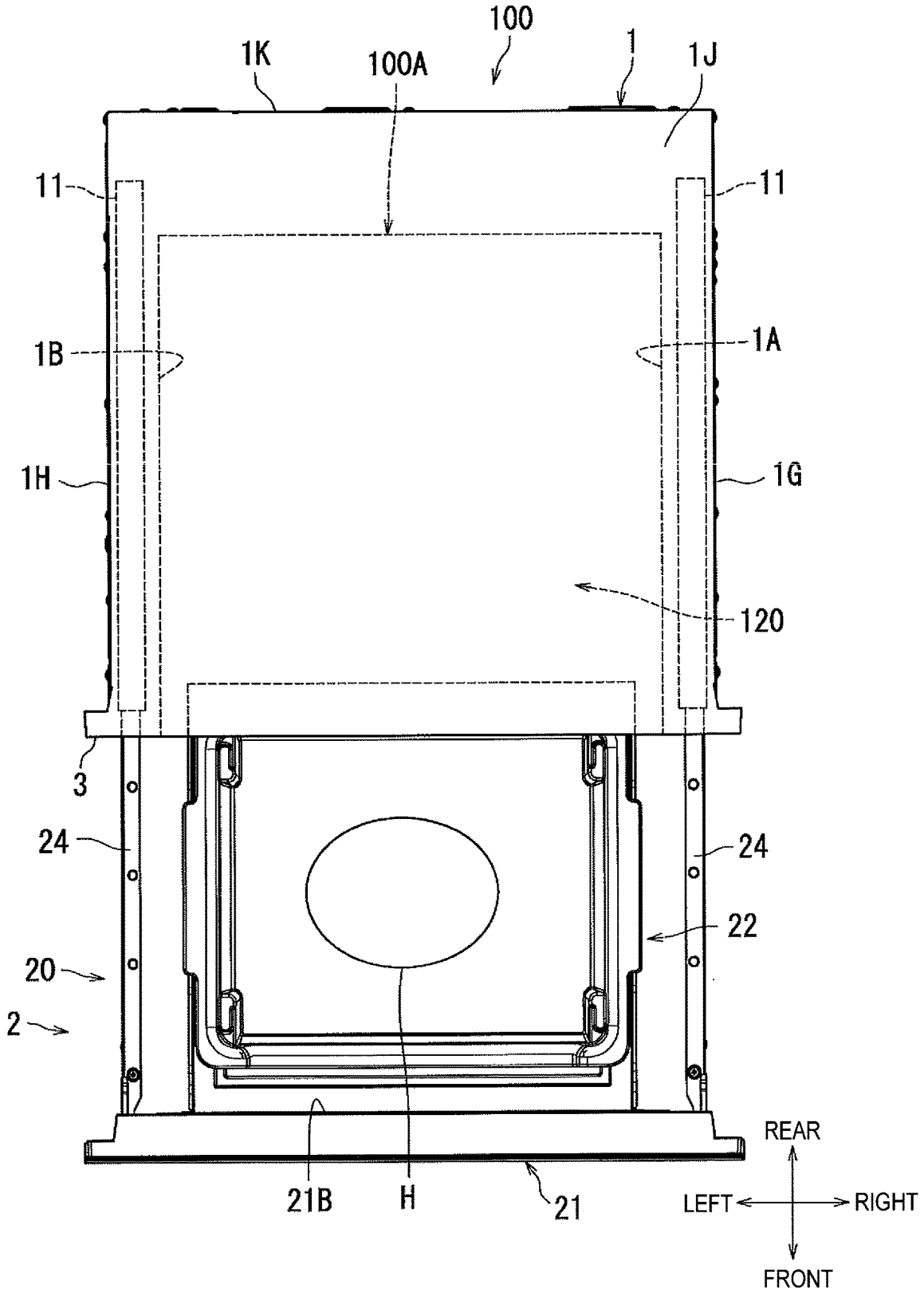
FIG. 3 is a top view illustrating the pull-out heating cooking appliance according to the present embodiment.

A pull-out heating cooking appliance 100 according to the present embodiment will be described with reference to FIGS. 1 to 3. FIG. 1 is a perspective view illustrating an appearance of the pull-out heating cooking appliance 100 according to the present embodiment. FIG. 2 is a right side view illustrating the pull-out heating cooking appliance 100 according to the present embodiment. In particular, FIGS. 1 and 2 illustrate the pull-out heating cooking appliance 100 with a pull-out body 2 being pulled out. Further, FIG. 1 illustrates the appearance of the pull-out heating cooking appliance 100 when viewed from above the diagonally forward right. The pull-out heating cooking appliance 100 is one example of a heating cooking appliance. FIG. 3 is a top view illustrating the pull-out heating cooking appliance 100 according to the present embodiment.

The pull-out heating cooking appliance 100 heats and cooks an object to be heated H. The object to be heated H is, for example, a food product. As illustrated in FIG. 1, the pull-out heating cooking appliance 100 includes a heating cabinet 1, the pull-out body 2, and an operation panel 3.

In the present embodiment, a side on which the operation panel 3 of the pull-out heating cooking appliance 100 is disposed is defined as a front side of the pull-out heating cooking appliance 100, and an opposite side thereof is defined as a rear side of the pull-out heating cooking appliance 100. Further, a right side of the pull-out heating cooking appliance 100 is defined as a right side when the pull-out heating cooking appliance 100 is viewed from the front side, and an opposite side thereof is defined as a left side of the pull-out heating cooking appliance 100. Further, in a direction orthogonal to a front-rear direction and a left-right direction of the pull-out heating cooking appliance 100, a side on which the operation panel 3 is disposed is defined as an upper side of the pull-out heating cooking appliance 100, and an opposite side thereof is defined as a lower side of the pull-out heating cooking appliance 100. Note that these orientations do not limit an orientation of the pull-out heating cooking appliance 100 according to the disclosure in use.

As illustrated in FIGS. 1 to 3, the heating cabinet 1 is a box-like member. Specifically, as illustrated in FIGS. 2 and 3, the heating cabinet 1 includes a right outer wall 1G, a left outer wall 1H, a top outer wall 1J, a bottom outer wall 1F, and a back outer wall 1K. Then, the heating cabinet 1 includes a heating cooking chamber 100A therein.

The heating cooking chamber 100A includes an accommodation space 120 that accommodates the object to be heated H. The accommodation space 120 has a predetermined volume as a space that can accommodate the object to be heated H. Specifically, the heating cooking chamber 100A includes a right wall 1A, a left wall 1B, a top wall 1C, a bottom wall 1D, and a back wall 1E. A shape of the heating cooking chamber 100A is, for example, a substantially rectangular parallelepiped. A material of the right wall 1A, the left wall 1B, the top wall 1C, the bottom wall 1D, and the back wall 1E is, for example, metal. The right wall 1A corresponds to one example of a "second side wall". The left wall 1B corresponds to one example of a "first side wall". The front side of the heating cooking chamber 100A is opened for allowing the object to be heated H to move in and out.

As illustrated in FIG. 2, the heating cabinet 1 further includes a space between the bottom wall 1D and the bottom outer wall 1F. The heating cabinet 1 further includes a space between the top wall 1C and the top outer wall 1J. The heating cabinet 1 further includes a space between the back wall 1E and the back outer wall 1K. As illustrated in FIG. 3, the heating cabinet 1 further includes a space between the right wall 1A and the right outer wall 1G. The heating cabinet 1 further includes a space between the left wall 1B and the left outer wall 1H.

The operation panel 3 includes an operation unit and a display unit. The operation unit receives an operation from a user. The operation unit includes various types of keys. The display unit displays various types of information. The display unit includes a liquid crystal panel. The operation panel 3 is located on an upper portion of a front surface of the heating cabinet 1.

The pull-out body 2 is freely pulled out of the heating cooking chamber 100A. Specifically, the pull-out body 2 can be pulled out and pulled in with respect to the heating cabinet 1. In particular, the pull-out body 2 includes a door portion 21, a mounting portion 22, and a support portion 23. The door portion 21 can open and close an opening on the front side of the heating cooking chamber 100A. The door portion 21 is a substantially rectangular plate-like member. The door portion 21 includes a front surface 21A and a rear surface 21B. The door portion 21 opens the opening on the front side of the heating cooking chamber 100A in a state in which the pull-out body 2 is pulled out of the heating cooking chamber 100A. The door portion 21 closes the opening on the front side of the heating cooking chamber 100A in a state in which the pull-out body 2 is pulled in the heating cooking chamber 100A.

The object to be heated H is placed on the mounting portion 22. The mounting portion 22 is, for example, a plate-like member made of ceramic or glass. The support portion 23 is fixed to the rear surface 21B of the door portion 21, and supports a peripheral portion of the mounting portion 22 such that the mounting portion 22 is maintained horizontally. A material of the support portion 23 includes metal. Then, the mounting portion 22 and the support portion 23 are pulled out of the heating cooking chamber 100A to the outside by pulling out the pull-out body 2. The mounting portion 22 and the support portion 23 are accommodated in the heating cooking chamber 100A in a state in which the pull-out body 2 is pulled in.

Further, the pull-out body 2 further includes a pair of slide members 24 and a support member 25 in addition to the door portion 21, the support portion 23, and the mounting portion 22.

The pair of slide members 24 move in the front-rear direction. The pair of slide members 24 are fixed to the rear surface 21B of the door portion 21. Specifically, one end portion of the pair of slide members 24 is attached to an edge portion of the rear surface 21B of the door portion 21.

Meanwhile, the heating cabinet 1 further includes a pair of slide rails 11. One of the pair of slide rails 11 is fixed in the space between the right wall 1A and the right outer wall 1G. The other one of the pair of slide rails 11 is fixed in the space between the left wall 1B and the left outer wall 1H. The pair of slide members 24 are slidably supported on the pair of slide rails 11.

Furthermore, the support member 25 supports the door portion 21. In particular, the support member 25 regulates a movement direction of the pull-out body 2 in the front-rear direction. One end portion of the support member 25 is attached to a central portion in the left-right direction of the rear surface 21B of the door portion 21 and below the mounting portion 22. The support member 25 is a member having the front-rear direction as a longitudinal direction.

Meanwhile, as illustrated in FIG. 2, the heating cabinet 1 further includes a driving mechanism 4. The driving mechanism 4 is accommodated in the space between the bottom wall 1D and the bottom outer wall 1F. For example, the driving mechanism 4 includes a driving motor 41 and a driving rail 42. The driving rail 42 is fixed in the space between the bottom wall 1D and the bottom outer wall 1F. The driving rail 42 is a member having the front-rear direction as a longitudinal direction. The support member 25 is slidably supported on the driving rail 42, and the support member 25 moves in the front-rear direction. As the support member 25 moves in the front-rear direction, the pair of slide members 24 also moves in the front-rear direction. As a result, the pull-out body 2 is in an open state or a closed state. Note that the driving mechanism 4 may drive at least one of the support member 25, a right slide member 241, and a left slide member 242. Then, when the driving mechanism 4 drives the right slide member 241 and the left slide member 242, the driving mechanism 4 may be located on a lateral side of the heating cooking chamber 100A.

Figure 4:
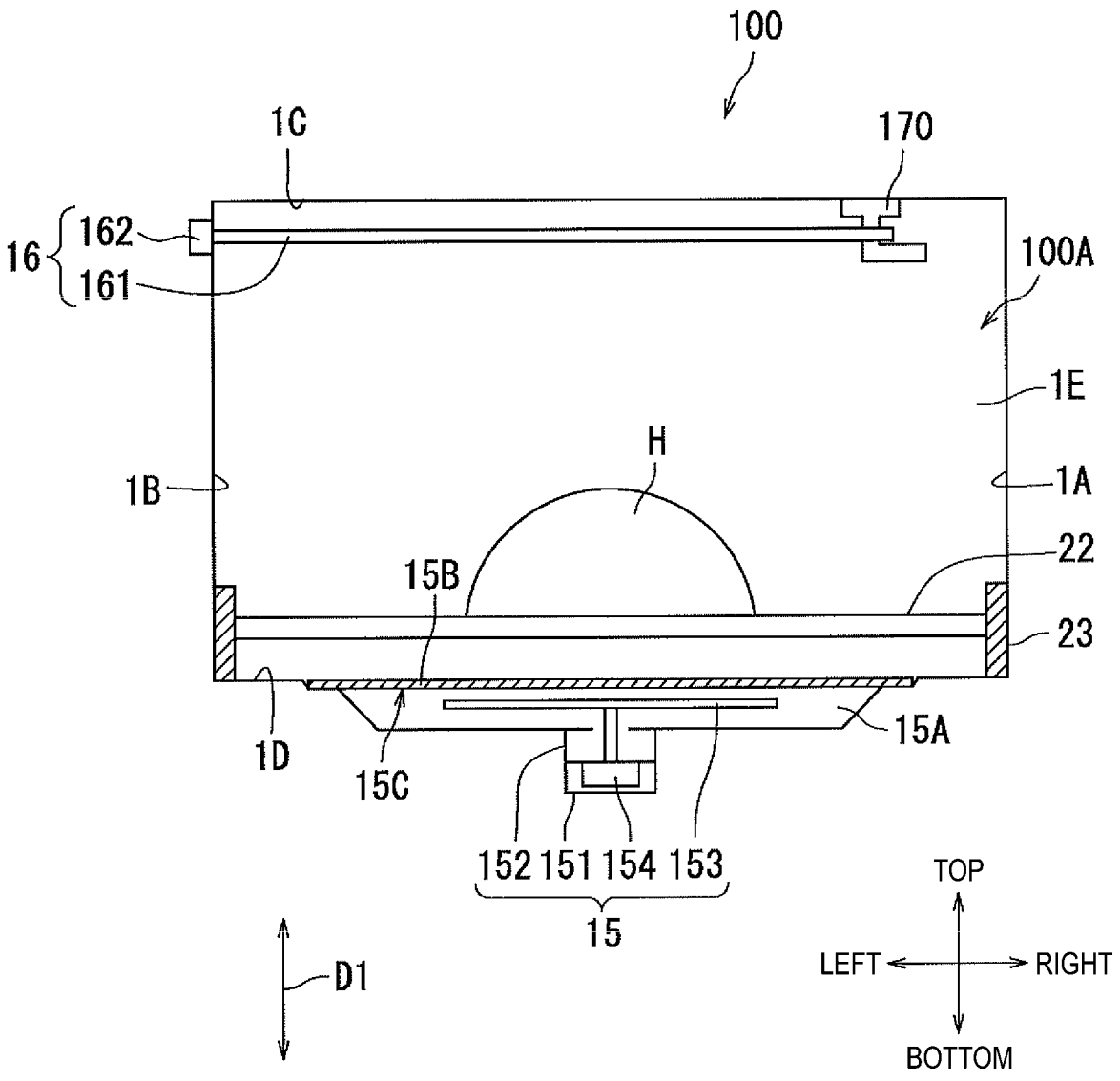
FIG. 4 is a diagram illustrating a schematic longitudinal cross-section of a heating cooking chamber according to the present embodiment.

Next, the heating cooking chamber 100A according to the present embodiment will be further described with reference to FIGS. 1 to 4. FIG. 4 is a diagram illustrating a schematic longitudinal cross-section of the heating cooking chamber 100A according to the present embodiment. In particular, FIG. 4 illustrates a cross-section of the heating cooking chamber 100A when the heating cooking chamber 100A is cut in an up-down direction.

As illustrated in FIG. 4, the pull-out heating cooking appliance 100 further includes a microwave supply unit 15 and a partition member 15B. The microwave supply unit 15 supplies a microwave into the heating cooking chamber 100A.

The microwave supply unit 15 is located outside the heating cooking chamber 100A with respect to the bottom wall 1D. The microwave supply unit 15 includes a radiation chamber 15A, a magnetron 151, a waveguide 152, a rotating antenna 153, and an antenna motor 154. The magnetron 151 generates a microwave. The magnetron 151 is one example of a microwave generation portion.

The radiation chamber 15A includes a radiation port 15C for radiating a microwave into the heating cooking chamber 100A. Then, the radiation port 15C is located below the heating cooking chamber 100A. Specifically, the radiation port 15C is located in an approximately central portion of the bottom wall 1D. The radiation port 15C is covered with the partition member 15B. The rotating antenna 153 is accommodated in the radiation chamber 15A. The antenna motor 154 drives the rotating antenna 153. The rotating antenna 153 agitates a microwave and provides the microwave into the heating cooking chamber 100A through the radiation port 15C and the partition member 15B.

The waveguide 152 guides a microwave from the magnetron 151 to the radiation port 15C. Then, the waveguide 152 is located below the heating cooking chamber 100A.

Figure 5:
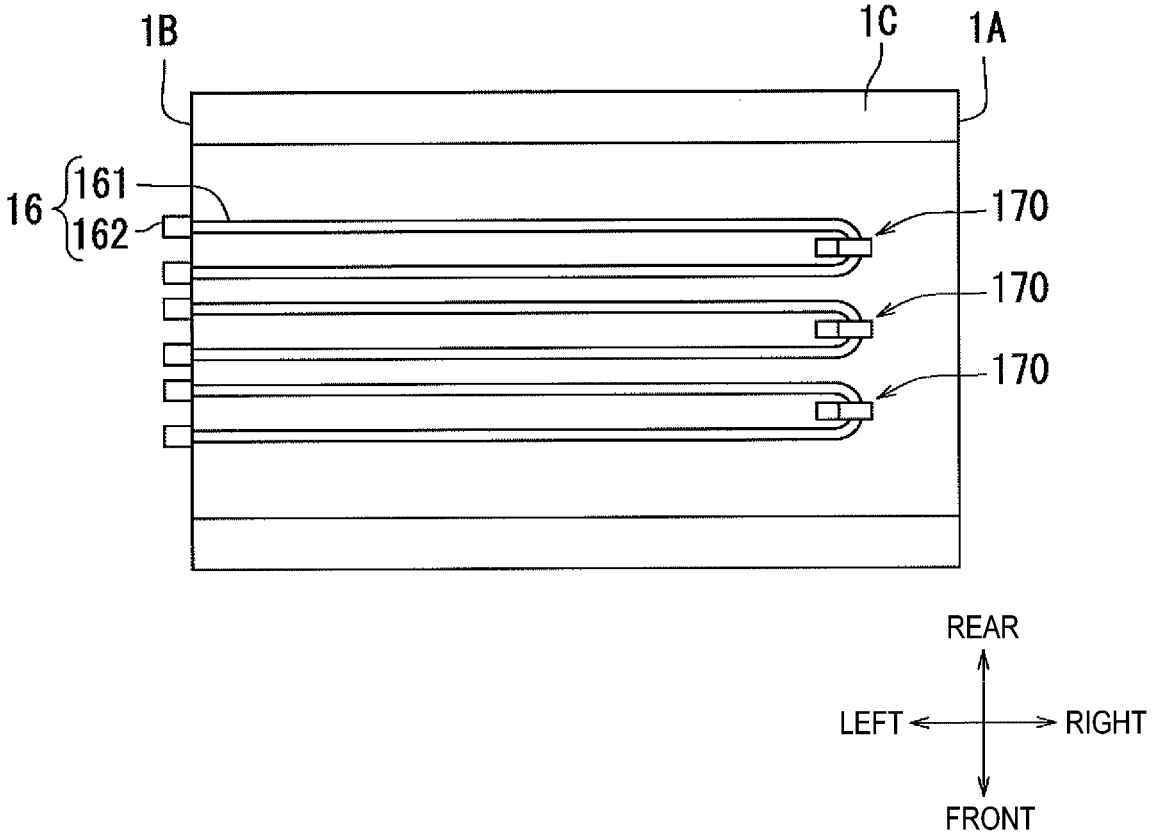
FIG. 5 is a diagram illustrating a schematic transverse cross-section of the heating cooking chamber according to the present embodiment.
Figure 6A:
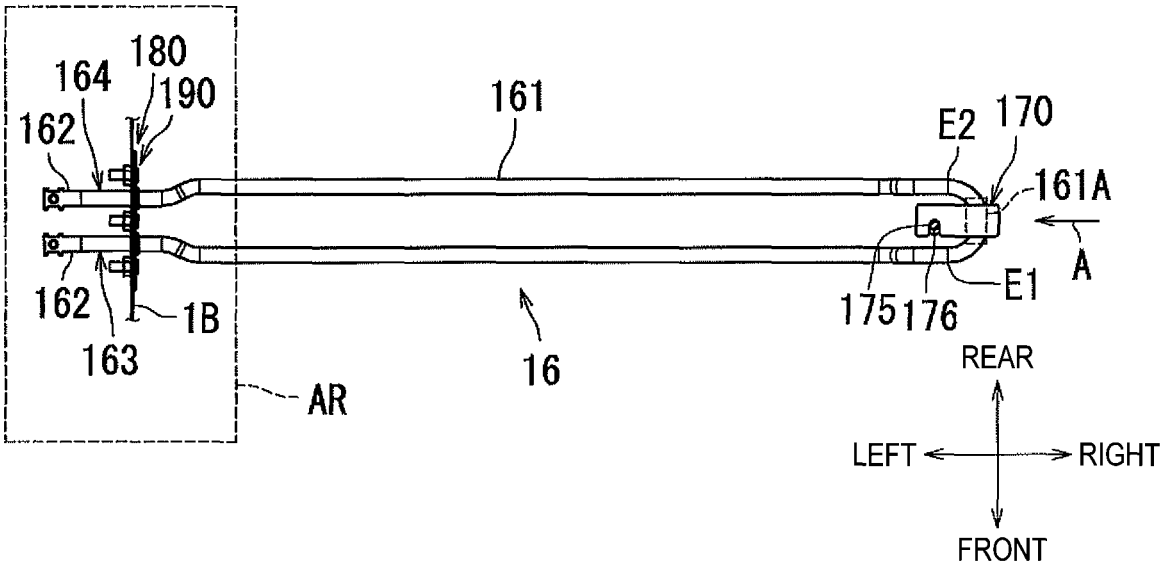
FIG. 6A is a diagram of a heater according to the present embodiment when viewed from a bottom wall side.
Figure 6B:
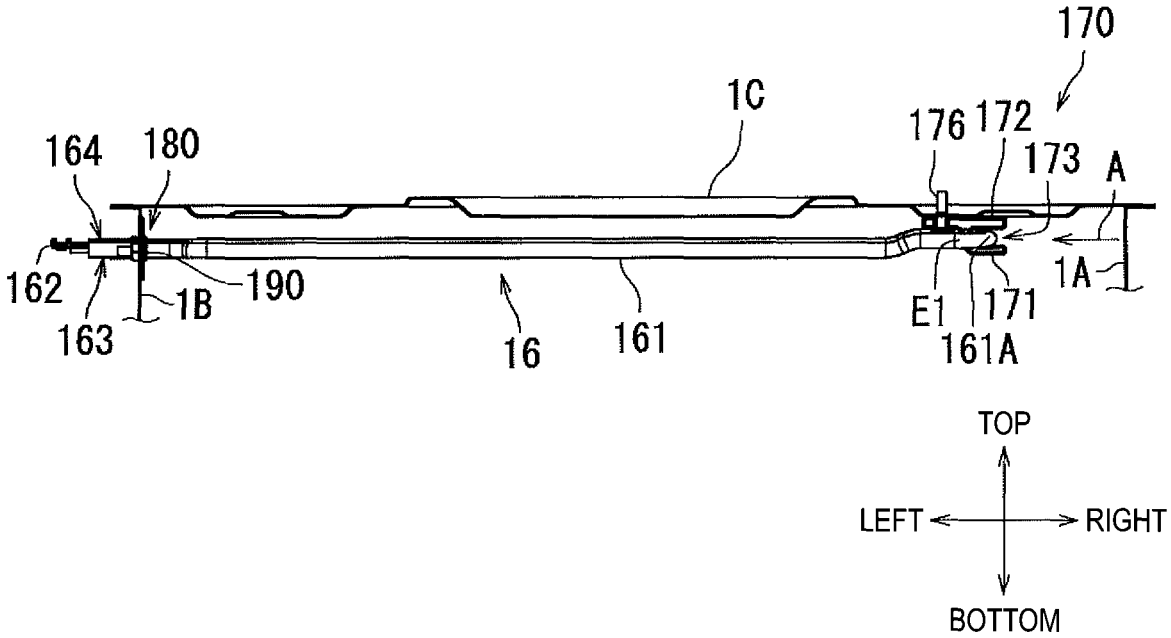
FIG. 6B is a diagram of the heater according to the present embodiment when viewed from a door portion side.

Next, a grill unit 16 according to the present embodiment will be described with reference to FIGS. 4 to 6B. FIG. 5 is a diagram illustrating a schematic transverse cross-section of the heating cooking chamber 100A according to the present embodiment. In particular, FIG. 5 illustrates a cross-section of the heating cooking chamber 100A when the heating cooking chamber 100A is cut in the left-right direction. FIG. 6A is a diagram of a heater 161 according to the present embodiment when viewed from a side of the bottom wall 1D. FIG. 6B is a diagram of the heater 161 according to the present embodiment when viewed from a side of the door portion 21.

As illustrated in FIG. 6A, the pull-out heating cooking appliance 100 further includes the grill unit 16, a support portion 170, a holding portion 180, and a fixing portion 190. The grill unit 16 includes the heater 161 and a pair of energization portions 162.

The heater 161 is located in the heating cooking chamber 100A, and heats the object to be heated H. In particular, the heater 161 is located on an upper portion in the heating cooking chamber 100A. As illustrated in FIG. 6A, the heater 161 extends from the left wall 1B toward the right wall 1A, folds back from a side of the right wall 1A, and extends to the left wall 1B. The heater 161 has a substantially U shape when viewed from the upper side to the lower side. In the present embodiment, three grill units 16 are disposed (FIG. 5). The heater 161 is, for example, a sheathed heater.

The heater 161 includes a first base end portion 163 and a second base end portion 164. The first base end portion 163 is disposed on the left wall 1B. Specifically, the first base end portion 163 is disposed on the left wall 1B separated from the second base end portion 164. In other words, the first base end portion 163 and the second base end portion 164 are separated from each other. The first base end portion 163 extends through the left wall 1B from an inner side of the heating cooking chamber 100A toward the left outer wall 1H. A part of the first base end portion 163 is located in the heating cooking chamber 100A. Then, another part of the first base end portion 163 is located between the left wall 1B and the left outer wall 1H. The energization portion 162 is connected to the first base end portion 163.

The second base end portion 164 is disposed on the left wall 1B. The second base end portion 164 extends through the left wall 1B from the inside of the heating cooking chamber 100A toward the left outer wall 1H. A part of the second base end portion 164 is located in the heating cooking chamber 100A. Then, another part of the second base end portion 164 is located between the left wall 1B and the left outer wall 1H. The energization portion 162 is connected to the second base end portion 164.

The energization portion 162 is located outside the left wall 1B. The energization portion 162 energizes the heater 161. The energized heater 161 generates heat.

As illustrated in FIGS. 6A and 6B, the support portion 170 supports a part 161A of the heater 161. The support portion 170 is disposed on the top wall 1C. The support portion 170 is, for example, ceramic. The support portion 170 includes a fixing hole 175.

As illustrated in FIG. 6B, a bolt 176 is inserted through the fixing hole 175. The bolt 176 is attached to the top wall 1C. In other words, by inserting the bolt 176 through the fixing hole 175 and attaching the bolt 176 to the top wall 1C, the support portion 170 is fixed to the top wall 1C.

The holding portion 180 holds the heater 161. The holding portion 180 will be described later with reference to FIG. 8.

The fixing portion 190 fixes the holding portion 180 to the left wall 1B. The fixing portion 190 will be described later with reference to FIG. 8.

Figure 7:
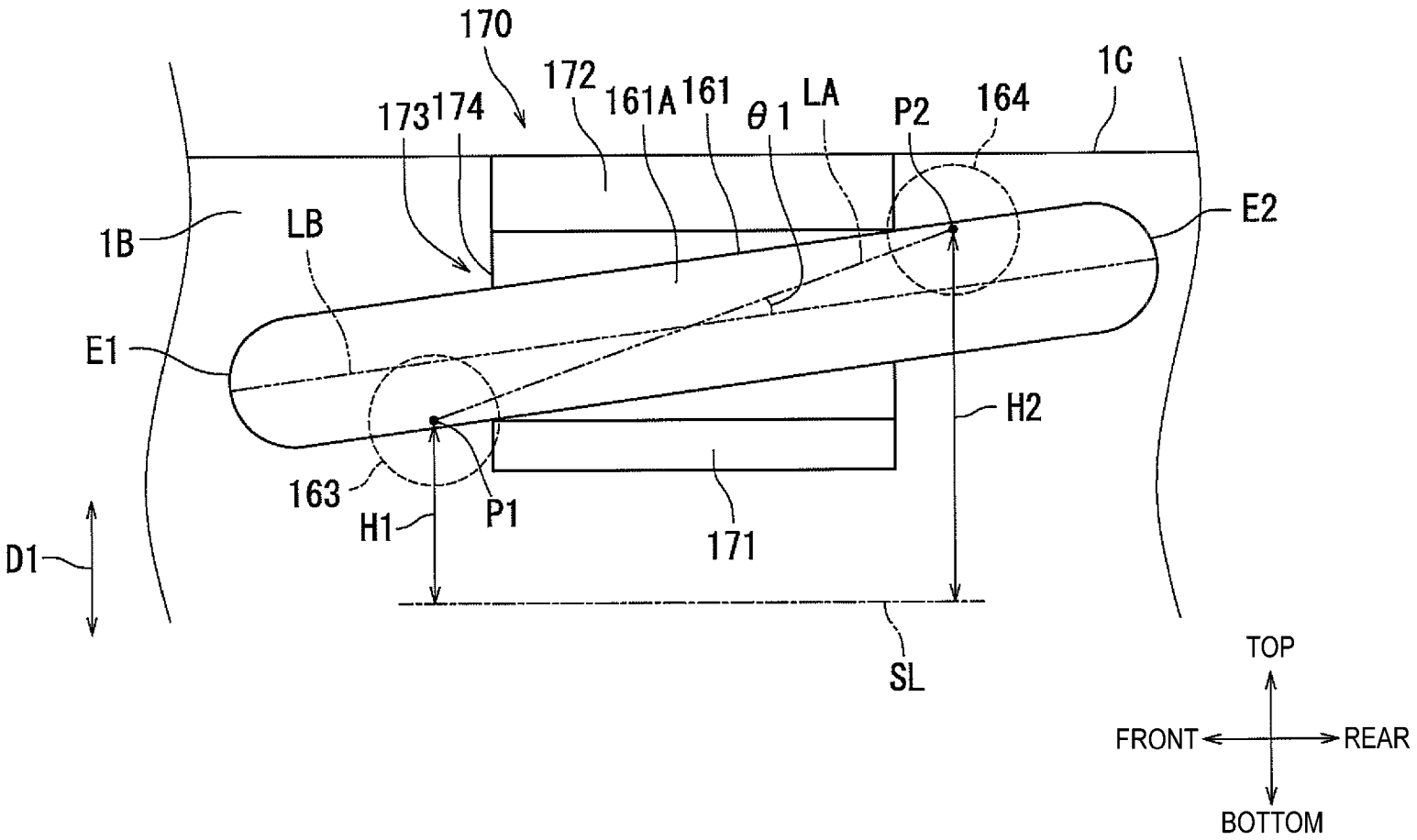
FIG. 7 is a schematic view illustrating the heater and a support portion according to the present embodiment.

Next, the heater 161 will be described in more detail with reference to FIGS. 6A to 7. FIG. 7 is a schematic view illustrating the heater 161 and the support portion 170 according to the present embodiment. In FIG. 7, the heater 161 is viewed from a direction A illustrated in FIGS. 6A and 6B. The direction A is a direction from the support portion 170 toward the left wall 1B. A reference line SL is illustrated in FIG. 7. The reference line SL is a line along a horizontal direction. Further, as illustrated in FIG. 7, the part 161A of the heater 161 includes a first end portion E1 and a second end portion E2. The first end portion E1 is an end portion of the part 161A of the heater 161 on a first base end portion 163 side. The second end portion E2 is an end portion of the part 161A of the heater 161 on a second base end portion 164 side.

As illustrated in FIG. 7, the first base end portion 163 is disposed in a position P1 on the left wall 1B. The center of the first base end portion 163 coincides with the position P1. The position P1 indicates a position separated from the reference line SL by a height H1 in a vertical direction D1. The vertical direction D1 is a direction orthogonal to the reference line SL. In other words, the first base end portion 163 is disposed in a position separated from the reference line SL by the height H1 in the vertical direction D1. In other words, the position separated from the reference line SL by the height H1 in the vertical direction D1 is a position of the first base end portion 163 on the left wall 1B along the vertical direction D1.

The second base end portion 164 is disposed in a position P2 on the left wall 1B. The center of the second base end portion 164 coincides with the position P2. The position P2 indicates a position separated from the reference line SL by a height H2 in the vertical direction D1. In other words, the second base end portion 164 is disposed in a position separated from the reference line SL by the height H2 in the vertical direction D1. In other words, the position separated from the reference line SL by the height H2 in the vertical direction D1 is the position P2 of the second base end portion 164 on the left wall 1B along the vertical direction D1.

The height H2 is greater than the height H1. In other words, the position P2 that coincides with the center of the second base end portion 164 is disposed in a position higher than the position P1 that coincides with the center of the first base end portion 163.

Further, in FIG. 7, a virtual line LA and a virtual line LB are illustrated. The virtual line LA is a virtual line connecting the position P1 and the position P2. The virtual line LB is a virtual line located between the first end portion E1 and the second end portion E2. As illustrated in FIG. 7, the virtual line LB and the virtual line LA viewed from a front direction do not coincide with each other. The front direction is the direction A. In other words, the virtual line LB is inclined to the virtual line LA by a predetermined angle 91. Thus, the part 161A of the heater 161 is fixed to the left wall 1B in a state of being inclined to the virtual line LA by the predetermined angle 91. The predetermined angle 91 is, for example, "3 degrees". In other words, the heater 161 is supported by the support portion 170 in a twisted state.

Further, the part 161A of the heater 161 is supported by the support portion 170. Then, the position P1 of the first base end portion 163 along the vertical direction D1 and the position P2 of the second base end portion 164 along the vertical direction D1 are different. An oscillation of the heater 161 can be suppressed by supporting the part 161A of the heater 161 by the support portion 170. Furthermore, since the position P1 of the first base end portion 163 and the position P2 of the second base end portion 164 are different, the part 161A of the heater 161 is supported by the support portion 170 in the twisted state. Therefore, a biasing force is generated in the heater 161 when the heater 161 returns from the twisted state, and the support portion 170 and the heater 161 abut each other. As a result, an oscillation of the heater 161 can be suppressed. Then, a reduction in durability of the heater 161 due to the oscillation of the heater 161 can be suppressed.

Further, as illustrated in FIG. 6A, the part 161A of the heater 161 is a folded portion of the heater 161. Therefore, an oscillation of the heater 161 can be suppressed by supporting the folded portion of the heater 161 by the support portion 170. As a result, abnormal sound generated by an oscillation of the heater 161 can be suppressed. For example, an amplitude of an oscillation of the part 161A (folded portion) of the heater 161 located on the side of the right wall 1A is greater than an amplitude of an oscillation of the first base end portion 163 and an amplitude of an oscillation of the second base end portion 164. In other words, the support portion 170 can support the folded portion of the heater 161, and thus an oscillation of the folded portion of the heater 161 can be suppressed.

Next, the support portion 170 will be described in more detail with reference to FIGS. 6A to 7. The support portion 170 further includes a first support portion 171, a second support portion 172, and a connection portion 174.

As illustrated in FIG. 7, the first support portion 171 abuts the part 161A of the heater 161. The first support portion 171 faces the second support portion 172 along the vertical direction D1. The first support portion 171 extends along the reference line SL.

The second support portion 172 abuts the part 161A of the heater 161. The second support portion 172 faces the first support portion 171 along the vertical direction D1. In other words, the first support portion 171 and the second support portion 172 face each other along the vertical direction D1. The second support portion 172 extends along the reference line SL.

The connection portion 174 connects the first support portion 171 and the second support portion 172. The connection portion 174 is located between the first support portion 171 and the second support portion 172. A space 173 is located between the first support portion 171 and the second support portion 172 connected by the connection portion 174. The part 161A of the heater 161 is located in the space 173.

As illustrated in FIG. 7, the part 161A of the heater 161 abuts the first support portion 171 and the second support portion 172 by a biasing force caused by twisting of the heater 161. In other words, a biasing force that returns the heater 161 to a state of before being twisted is generated in the twisted heater 161 and causes the heater 161 to elastically return. On the other hand, the first support portion 171 abuts the heater 161 so as to oppose the biasing force generated in the heater 161. Further, the second support portion 172 abuts the heater 161 so as to oppose the biasing force generated in the heater 161. Therefore, a contact place between the heater 161 and the support portion 170 is increased. As a result, an oscillation of the heater 161 can be suppressed, and abnormal sound generated by the oscillation of the heater 161 can be suppressed.

Figure 8:
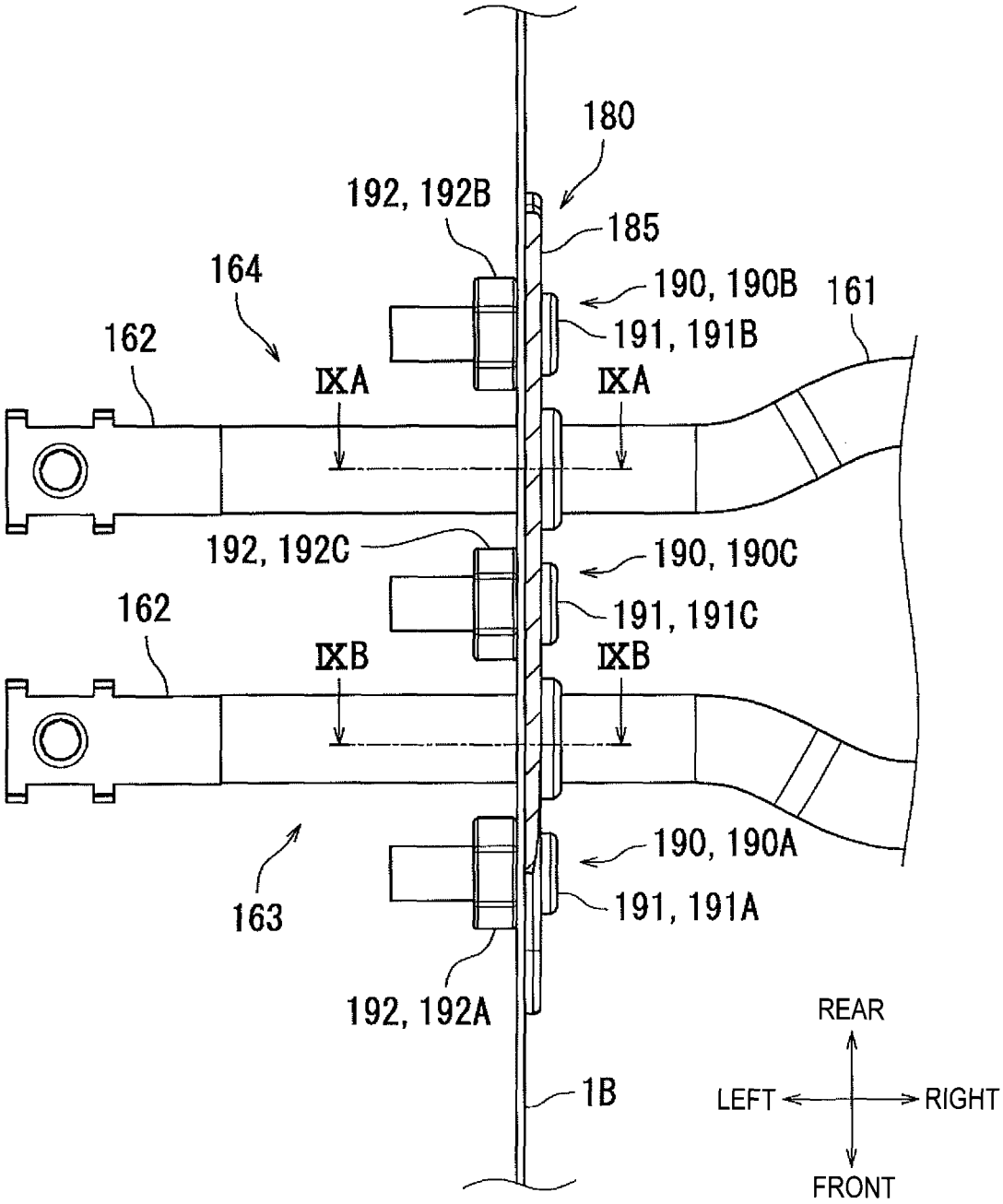
FIG. 8 is an enlarged view illustrating a region AR illustrated in FIG. 6A.
Figure 9A:
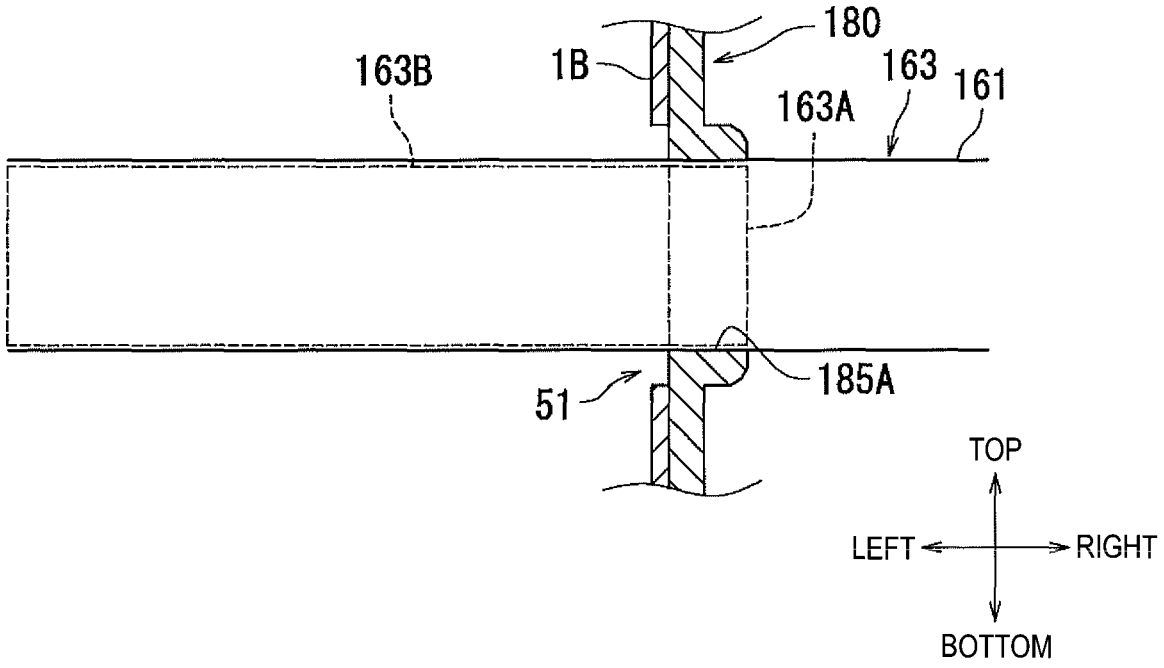
FIG. 9A is a diagram illustrating an IXA-IXA cross-section illustrated in FIG. 8.
Figure 9B:
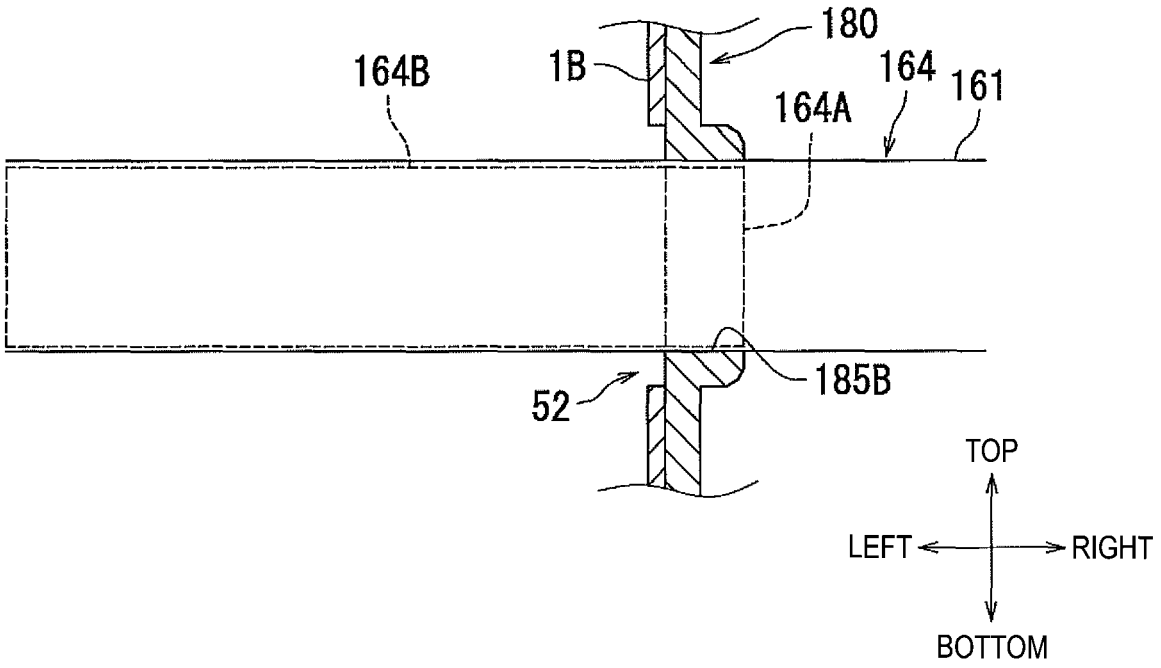
FIG. 9B is a diagram illustrating an IXB-IXB cross-section illustrated in FIG. 8.

Next, the heater 161 will be described in more detail with reference to FIGS. 3, 6A, 6B, 8, 9A, and 9B. FIG. 8 is an enlarged view illustrating a region AR illustrated in FIG. 6A. The first base end portion 163 and the second base end portion 164 illustrated in the region AR in FIG. 6A are enlarged and illustrated in FIG. 8. FIG. 9A is a diagram illustrating an IXA-IXA cross-section illustrated in FIG. 8. FIG. 9A schematically illustrates the first base end portion 163 according to the present embodiment. Further, for ease of understanding, the cross-section of the first base end portion 163 is not provided with hatching. FIG. 9B is a diagram illustrating an IXB-IXB cross-section illustrated in FIG. 8. FIG. 9B schematically illustrates the second base end portion 164 according to the present embodiment. Furthermore, for ease of understanding, the cross-section of the second base end portion 164 is not provided with hatching.

As illustrated in FIG. 9A, the first base end portion 163 includes a first held portion 163A and a first insertion portion 163B.

The first held portion 163A is a portion of the first base end portion 163 being held by the holding portion 180. Note that the first held portion 163A may be fixed to the holding portion 180 so as not to shift the position.

The first insertion portion 163B is a portion of the first base end portion 163 inserted through the left wall 1B. As illustrated in FIG. 3, the first insertion portion 163B inserted through the left wall 1B protrudes from the left wall 1B toward the left outer wall 1H. The energization portion 162 is connected to an end portion of the first insertion portion 163B. Note that, as illustrated in FIG. 9A, the first insertion portion 163B does not contact the left wall 1B.

As illustrated in FIG. 9B, the second base end portion 164 includes a second held portion 164A and a second insertion portion 164B.

The second held portion 164A is a portion of the second base end portion 164 being held by the holding portion 180. Note that the second held portion 164A may be fixed to the holding portion 180 so as not to shift position.

The second insertion portion 164B is a portion of the second base end portion 164 inserted through the left wall 1B. As illustrated in FIG. 3, the second insertion portion 164B inserted through the left wall 1B protrudes from the left wall 1B toward the left outer wall 1H. The energization portion 162 is connected to an end portion of the second insertion portion 164B. Note that, as illustrated in FIG. 9B, the second insertion portion 164B does not contact the left wall 1B.

Figure 10:
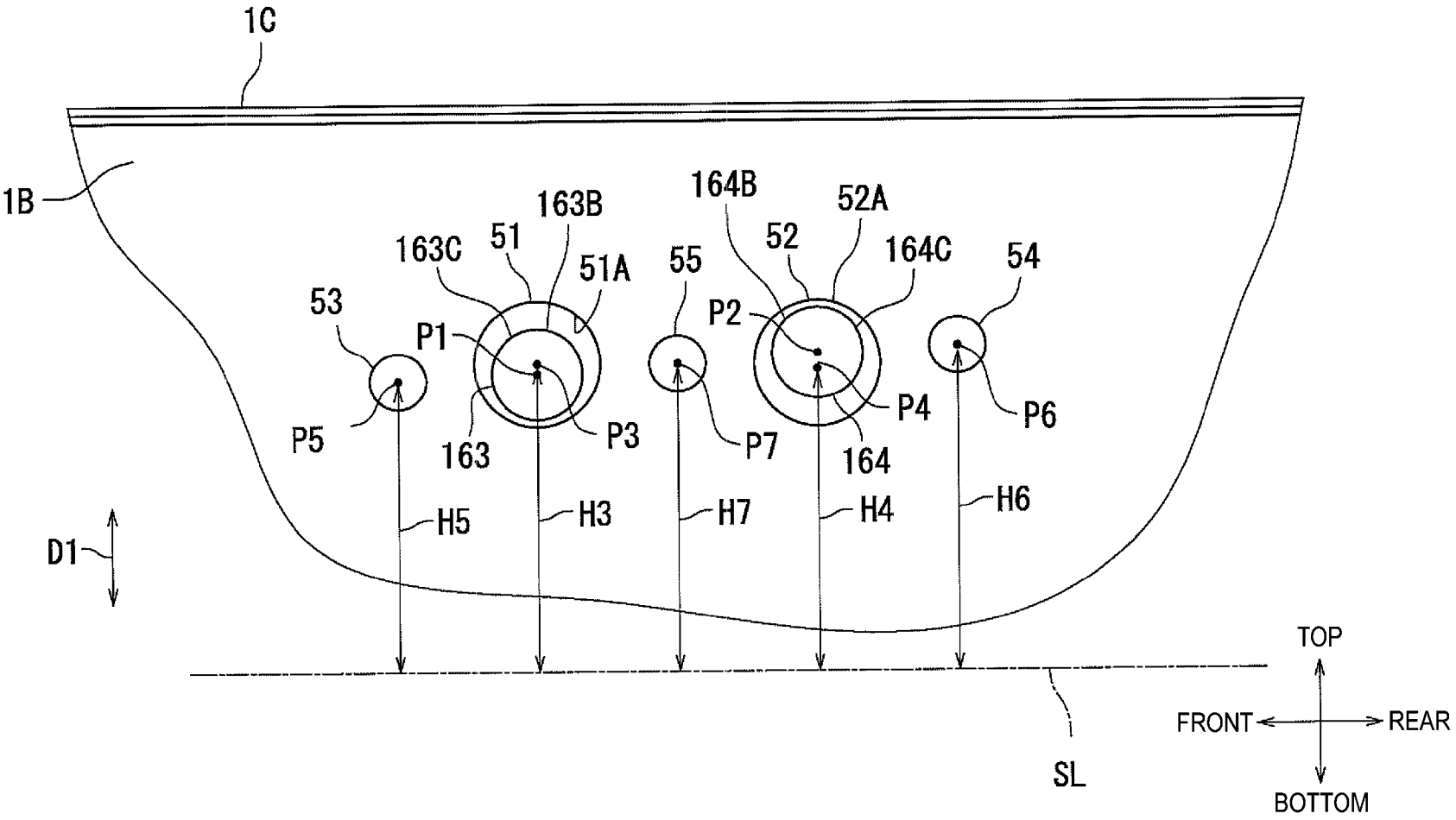
FIG. 10 is a diagram illustrating a left wall and a through hole disposed in the left wall according to the present embodiment.

Next, the left wall 1B according to the present embodiment will be described in detail with reference to FIGS. 9A, 9B, and 10. FIG. 10 is a diagram illustrating the left wall 1B and a through hole disposed in the left wall 1B according to the present embodiment. In FIG. 10, a part of the left wall 1B is illustrated for ease of understanding. Further, FIG. 10 illustrates a position of the first insertion portion 163B and a position of the second insertion portion 164B when the first base end portion 163 and the second base end portion 164 are attached to the left wall 1B.

As illustrated in FIG. 10, the left wall 1B includes a first through hole 51, a second through hole 52, a third through hole 53, a fourth through hole 54, and a fifth through hole 55.

The first base end portion 163 is inserted through the first through hole 51. Specifically, as illustrated in FIG. 9A, the first insertion portion 163B is inserted through the first through hole 51. An inner diameter 51A of the first through hole 51 is larger than an outer diameter 163C of the first insertion portion 163B. As illustrated in FIGS. 9A, 9B, and 10, the first base end portion 163 is attached to the left wall 1B such that the first insertion portion 163B does not abut the first through hole 51.

The first through hole 51 is disposed in a position P3. The center of the first through hole 51 coincides with the position P3. The position P3 indicates a position separated from the reference line SL by a height H3 in the vertical direction D1. In other words, the first through hole 51 is disposed in a position separated from the reference line SL by the height H3 in the vertical direction D1. The first through hole 51 is located between the third through hole 53 and the fifth through hole 55.

The second base end portion 164 is inserted through the second through hole 52. Specifically, as illustrated in FIG. 9B, the second insertion portion 164B is inserted through the second through hole 52. An inner diameter 52A of the second through hole 52 is larger than an outer diameter 164C of the second insertion portion 164B. As illustrated in FIGS. 9 and 10, the second base end portion 164 is attached to the left wall 1B such that the second insertion portion 164B does not abut the second through hole 52.

The second through hole 52 is located in a position P4. The center of the second through hole 52 coincides with the position P4. The position P4 indicates a position separated from the reference line SL by a height H4 in the vertical direction D1. In other words, the second through hole 52 is disposed in a position separated from the reference line SL by the height H4 in the vertical direction D1. The second through hole 52 is located between the fourth through hole 54 and the fifth through hole 55. The height H4 is the same height as the height H3.

The third through hole 53 connects the accommodation space 120 and the space between the left wall 1B and the left outer wall 1H. The third through hole 53 is located in a position P5. The center of the third through hole 53 coincides with the position P5. The position P5 indicates a position separated from the reference line SL by a height H5 in the vertical direction D1. In other words, the third through hole 53 is disposed in a position separated from the reference line SL by the height H5 in the vertical direction D1. The third through hole 53 is located on an opposite side of the fifth through hole 55 with respect to the first through hole 51. The height H5 is lower than the height H3 and the height H4.

The fourth through hole 54 connects the accommodation space 120 and the space between the left wall 1B and the left outer wall 1H. The fourth through hole 54 is located in a position P6. The center of the fourth through hole 54 coincides with the position P6. The position P6 indicates a position separated from the reference line SL by a height H6 in the vertical direction D1. In other words, the fourth through hole 54 is disposed in a position separated from the reference line SL by the height H6 in the vertical direction D1. The fourth through hole 54 is located on an opposite side of the fifth through hole 55 with respect to the second through hole 52. The height H6 is greater than the height H5. Further, the height H6 is greater than the height H3 and the height H4.

The fifth through hole 55 connects the accommodation space 120 and the space between the left wall 1B and the left outer wall 1H. The fifth through hole 55 is located in a position P7. The center of the fifth through hole 55 coincides with the position P7. The position P7 indicates a position separated from the reference line SL by a height H7 in the vertical direction D1. In other words, the fifth through hole 55 is disposed in a position separated from the reference line SL by the height H7 in the vertical direction D1. The fifth through hole 55 is located between the first through hole 51 and the second through hole 52. The position P7 of the fifth through hole 55 is located at a midpoint of a line segment connecting the position P3 of the first through hole 51 and the position P4 of the second through hole 52. Further, the fifth through hole 55 is located between the third through hole 53 and the fourth through hole 54. The height H7 is greater than the height H5. Further, the height H7 is lower than the height H6. Further, the height H7 substantially coincides with the height H3 and the height H4.

Figure 11:
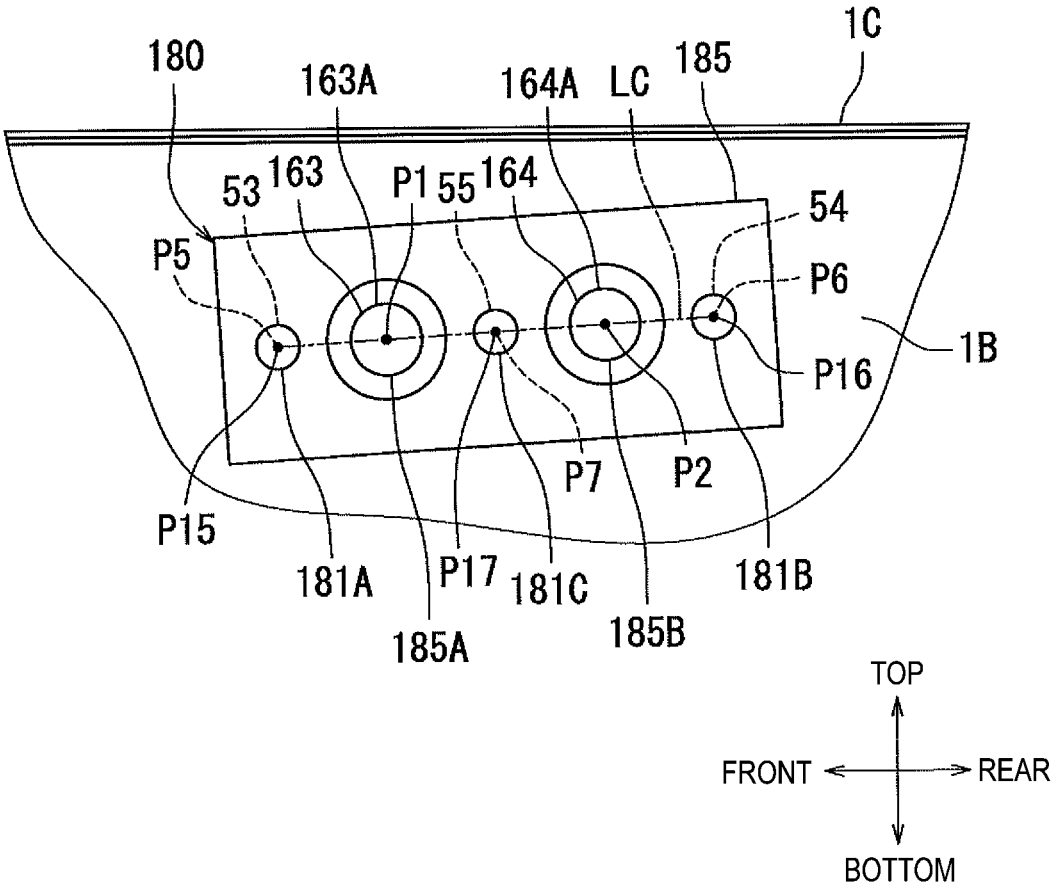
FIG. 11 is a diagram illustrating a holding portion according to the present embodiment.

Next, the holding portion 180 according to the present embodiment will be described in detail with reference to FIGS. 8 to 11. FIG. 11 is a diagram illustrating the holding portion 180 according to the present embodiment. In FIG. 11, the holding portion 180 is disposed on the left wall 1B so as to correspond to the first through hole 51 to the fifth through hole 55 of the left wall 1B. Further, FIG. 11 illustrates the first held portion 163A of the first base end portion 163 and the second held portion 164A of the second base end portion 164 for ease of understanding.

As illustrated in FIG. 8, the holding portion 180 holds the first base end portion 163 and the second base end portion 164. The holding portion 180 is disposed along the left wall 1B.

As illustrated in FIG. 11, the holding portion 180 includes a main body portion 185. The main body portion 185 has a flat plate shape. The holding portion 180 includes a first holding portion 185A, a second holding portion 185B, a third holding portion 181A, a fourth holding portion 181B, and a fifth holding portion 181C.

The first holding portion 185A holds the first base end portion 163. Specifically, the first holding portion 185A holds the first held portion 163A. The first holding portion 185A is a through hole. An inner diameter of the first holding portion 185A is larger than the outer diameter 163C of the first held portion 163A. The inner diameter of the first holding portion 185A is smaller than the inner diameter of the first through hole 51 illustrated in FIG. 10.

When the holding portion 180 is fixed to the left wall 1B by the fixing portion 190, the first holding portion 185A is located inside the first through hole 51, as illustrated in FIG.

10. The first holding portion 185A is located between the third holding portion 181A and the fifth holding portion 181C.

The second holding portion 185B holds the second base end portion 164. Specifically, as illustrated in FIG. 9B, the second holding portion 185B holds the second held portion 164A. The second holding portion 185B is a through hole. An inner diameter of the second holding portion 185B is larger than the outer diameter 164C of the second held portion 164A. The inner diameter of the second holding portion 185B illustrated in FIG. 11 is smaller than the inner diameter of the second through hole 52 illustrated in FIG. 10.

When the holding portion 180 is fixed to the left wall 1B by the fixing portion 190, the second holding portion 185B is located inside the second through hole 52, as illustrated in FIG. 10. Further, the second holding portion 185B is located between the fourth holding portion 181B and the fifth holding portion 181C.

The third holding portion 181A is a through hole. The size of the through hole that is the third holding portion 181A substantially coincides with the size of the third through hole 53. When the holding portion 180 is fixed to the left wall 1B by the fixing portion 190, a position P15 of the third holding portion 181A is the same position as the position P5 of the third through hole 53. The third holding portion 181A is located on an opposite side of the fifth holding portion 181C with respect to the first holding portion 185A.

The fourth holding portion 181B is a through hole. The size of the through hole that is the fourth holding portion 181B substantially coincides with the size of the fourth through hole 54. When the holding portion 180 is fixed to the left wall 1B by the fixing portion 190, a position P16 of the fourth holding portion 181B is the same position as the position P6 of the fourth through hole 54. The fourth holding portion 181B is located on an opposite side of the fifth holding portion 181C with respect to the second holding portion 185B.

The fifth holding portion 181C is a through hole. The size of the through hole that is the fifth holding portion 181C substantially coincides with the size of the fifth through hole 55. When the holding portion 180 is fixed to the left wall 1B by the fixing portion 190, a position P17 of the fifth holding portion 181C is the same position as the position P7 of the fifth through hole 55. The fifth holding portion 181C is located between the first holding portion 185A and the second holding portion 185B. Further, the fifth holding portion 181C is located between the third holding portion 181A and the fourth holding portion 181B.

Further, FIG. 11 illustrates a line segment LC. The line segment LC is a line segment connecting the center of the third holding portion 181A and the center of the fourth holding portion 181B. An angle of the line segment LC coincides with the angle of the virtual line LA. The center of the first holding portion 185A, the center of the second holding portion 185B, the center of the third holding portion 181A, the center of the fourth holding portion 181B, and the center of the fifth holding portion 181C are located on the line segment LC. Note that the holding portion 180 before being attached to the left wall 1B is not inclined. The third holding portion 181A and the fourth holding portion 181B, as illustrated in FIG. 11, respectively coincide with the position P5 of the third through hole 53 and the position P6 of the fourth through hole 54 having heights different from each other as illustrated in FIG. 10, and thus the holding portion 180 is fixed in an inclined state. Then, the heater 161 held by the holding portion 180 is also inclined.

Figure 12:
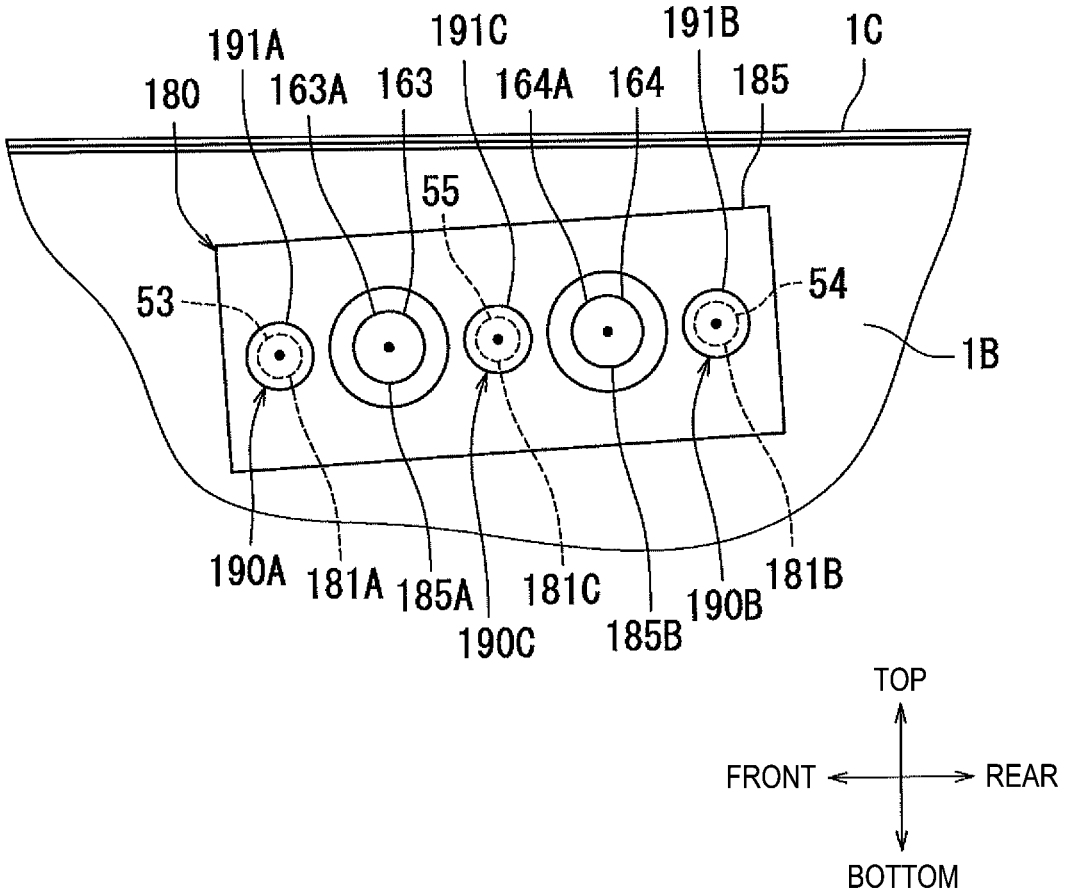
FIG. 12 is a diagram illustrating the holding portion fixed by a fixing portion according to the present embodiment.
Figure 13:
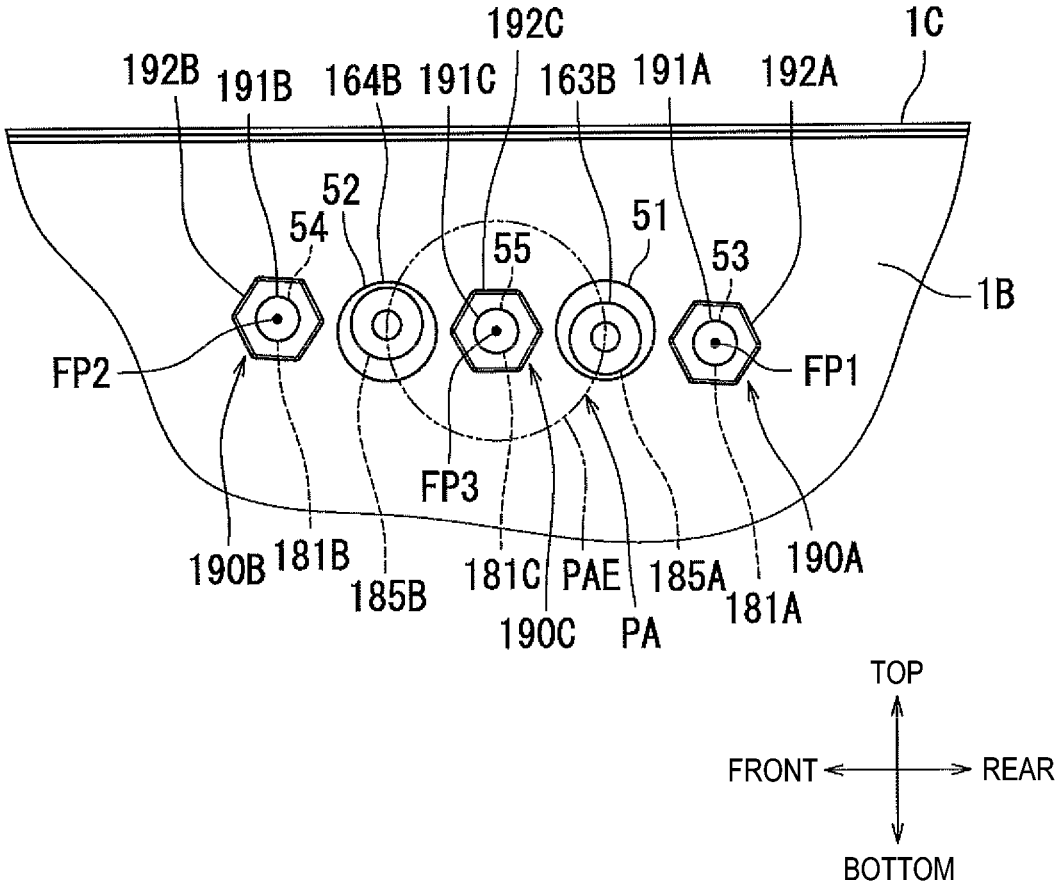
FIG. 13 is a diagram of the fixing portion according to the present embodiment when viewed from a side different from that in FIG. 12.

Next, the fixing portion 190 according to the present embodiment will be described in more detail with reference to FIGS. 8 and 10 to 13. FIG. 12 is a diagram illustrating the holding portion 180 fixed by the fixing portion 190 according to the present embodiment. FIG. 13 is a diagram of the fixing portion 190 according to the present embodiment when viewed from a side different from that in FIG. 12. As illustrated in FIGS. 12 and 13, the fixing portion 190 fixes the holding portion 180 to the left wall 1B while the third through hole 53 to the fifth through hole 55 coincide with the third holding portion 181A to the fifth holding portion 181C.

As illustrated in FIG. 8, the fixing portion 190 fixes, to the left wall 1B, the holding portion 180 that holds the first base end portion 163 and the second base end portion 164. In other words, the heater 161 is fixed to the left wall 1B by the fixing portion 190. The fixing portion 190 is, for example, a bolt 191 and a nut 192. The bolt 191 and the nut 192 tighten the holding portion 180 and the left wall 1B. The bolt 191 is inserted from the inside of the heating cooking chamber 100A toward the left outer wall 1H. The nut 192 is located between the left wall 1B and the left outer wall 1H. Therefore, the fixing portion 190 can fix, to the left wall 1B, the holding portion 180 that holds the first base end portion 163 and the second base end portion 164.

The fixing portion 190 includes a first fixing member 190A, a second fixing member 190B, and a third fixing member 190C.

The first fixing member 190A fixes the holding portion 180 to the left wall 1B. Specifically, as illustrated in FIG. 13, the first fixing member 190A fixes the holding portion 180 to the left wall 1B in a first fixing position FP1. The first fixing member 190A is located on an opposite side of the second fixing member 190B with respect to the third fixing member 190C.

The second fixing member 190B fixes the holding portion 180 to the left wall 1B. Specifically, as illustrated in FIG. 13, the second fixing member 190B fixes the holding portion 180 to the left wall 1B in a second fixing position FP2. The second fixing member 190B is located on an opposite side of the first fixing member 190A with respect to the third fixing member 190C.

The third fixing member 190C fixes the holding portion 180 to the left wall 1B. Specifically, as illustrated in FIG. 13, the third fixing member 190C fixes the holding portion 180 to the left wall 1B in a third fixing position FP3. The third fixing member 190C is located between the first fixing member 190A and the second fixing member 190B.

As illustrated in FIG. 13, the third fixing position FP3 indicates a position in contact with a predetermined region PA of the left wall 1B. An outer edge PAE of the predetermined region PA passes through the first through hole 51 and the second through hole 52. Specifically, the outer edge PAE of the predetermined region PA passes through the center of the first through hole 51 and the center of the second through hole 52. Further, the third fixing position FP3 may be, for example, a position in contact with the outer edge PAE of the predetermined region PA. The position in contact with the outer edge PAE is, for example, a position on the outer edge PAE. Further, the position in contact with the outer edge PAE may be, for example, a position outside the predetermined region PA and in contact with the outer edge PAE. Further, the third fixing position FP3 is the same position as the position P7 of the fifth through hole 55 illustrated in FIG. 10. The position P7 of the fifth through hole 55 is determined based on the third fixing position FP3.

The first fixing position FP1 indicates a position on an opposite side of the third fixing position FP3 with respect to the first through hole 51 illustrated in FIG. 13. The first fixing position FP1 is the same position as the position P5 of the third through hole 53 illustrated in FIG. 10. In other words, the third through hole 53 is disposed in a position corresponding to the first fixing position FP1.

The second fixing position FP2 indicates a position on an opposite side of the third fixing position FP3 with respect to the second through hole 52 illustrated in FIG. 13. The second fixing position FP2 is the same position as the position P6 of the fourth through hole 54 illustrated in FIG. 10. In other words, the fourth through hole 54 is disposed in a position corresponding to the second fixing position FP2.

In each of the first fixing position FP1 to the third fixing position FP3, the fixing portion 190 fixes the holding portion 180 to the left wall 1B. Therefore, the holding portion 180 being lifted from the left wall 1B can be suppressed. As a result, a leakage of a microwave from the first through hole 51 and the second through hole 52 due to the holding portion 180 being lifted from the left wall 1B can be suppressed.

Further, the third fixing position FP3 is located between the first through hole 51 and the second through hole 52. Therefore, the holding portion 180 being lifted from the left wall 1B can be further suppressed. As a result, a leakage of a microwave from the first through hole 51 and the second through hole 52 due to the holding portion 180 being lifted from the left wall 1B can be further suppressed.

Note that the third fixing position FP3 may be a position indicating a midpoint of a line segment connecting the first through hole 51 and the second through hole 52. Therefore, the holding portion 180 being lifted from the left wall 1B can be more effectively suppressed. As a result, a leakage of a microwave from the first through hole 51 and the second through hole 52 due to the holding portion 180 being lifted from the left wall 1B can be further suppressed.

Next, the fixing portion 190 according to the present embodiment will be described in more detail with reference to FIGS. 12 and 13.

The first fixing member 190A includes a first bolt 191A and a first nut 192A. The first bolt 191A is inserted through the third holding portion 181A. The first bolt 191A is inserted through the third through hole 53. An outer diameter of the first bolt 191A is smaller than an inner diameter of the third through hole 53. The outer diameter of the first bolt 191A is smaller than an inner diameter of the third holding portion 181A. The first nut 192A is attached to the first bolt 191A. As illustrated in FIG. 12, the first bolt 191A is inserted through the third through hole 53 and the third holding portion 181A in a state where the third through hole 53 illustrated in FIG. 10 and the third holding portion 181A illustrated in FIG. 11 coincide with each other. Then, as illustrated in FIG. 13, the first nut 192A is attached to the first bolt 191A.

The second fixing member 190B includes a second bolt 191B and a second nut 192B. The second bolt 191B is inserted through the fourth holding portion 181B. The second bolt 191B is inserted through the fourth through hole 54. An outer diameter of the second bolt 191B is smaller than an inner diameter of the fourth through hole 54. The outer diameter of the second bolt 191B is smaller than an inner diameter of the fourth holding portion 181B. The second nut 192B is attached to the second bolt 191B. As illustrated in FIG. 12, the second bolt 191B is inserted through the fourth through hole 54 and the fourth holding portion 181B in a state where the fourth through hole 54 illustrated in FIG. 10 and the fourth holding portion 181B illustrated in FIG. 11 coincide with each other. Then, as illustrated in FIG. 13, the second nut 192B is attached to the second bolt 191B.

The third fixing member 190C includes a third bolt 191C and a third nut 192C. The third bolt 191C is inserted through the fifth holding portion 181C. The third bolt 191C is inserted through the fifth through hole 55. An outer diameter of the third bolt 191C is smaller than an inner diameter of the fifth through hole 55. The outer diameter of the third bolt 191C is smaller than an inner diameter of the fifth holding portion 181C. The third nut 192C is attached to the third bolt 191C. As illustrated in FIG. 12, the third bolt 191C is inserted through the fifth through hole 55 and the fifth holding portion 181C in a state where the fifth through hole 55 illustrated in FIG. 10 and the fifth holding portion 181C illustrated in FIG. 11 coincide with each other. Then, as illustrated in FIG. 13, the third nut 192C is attached to the third bolt 191C.

The first fixing member 190A, the second fixing member 190B, and the third fixing member 190C can fix the holding portion 180 to the left wall 1B. Accordingly, generation of a gap between the holding portion 180 and the left wall 1B can be suppressed. As a result, a microwave entering from the gap and the microwave leaking to the outside of the heating cooking chamber 100A via the heater 161 can be suppressed.

Figure 14:
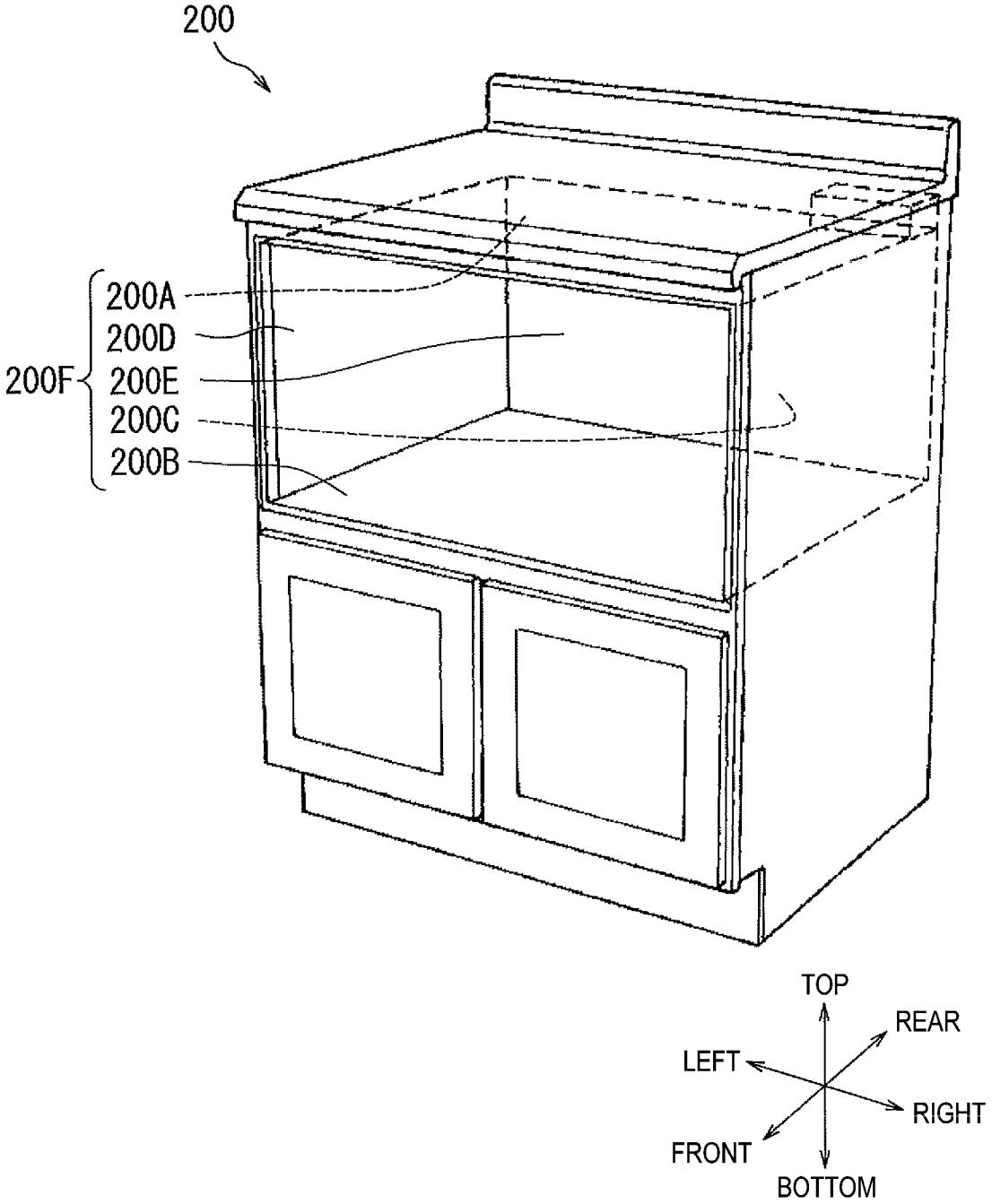
FIG. 14 is a diagram illustrating an appearance of a cabinet to which the pull-out heating cooking appliance according to the present embodiment is attached.

Next, a cabinet 200 to which the pull-out heating cooking appliance 100 is attached will be described with reference to FIG. 14. FIG. 14 is a diagram illustrating an appearance of the cabinet 200 to which the pull-out heating cooking appliance 100 according to the present embodiment is attached.

The pull-out heating cooking appliance 100 is installed in the cabinet 200 in built-in manner. As illustrated in FIG. 14, the cabinet 200 includes an upper wall 200A, a lower wall 200B, a right wall 200C, a left wall 200D, and a rear wall 200E. The upper wall 200A, the lower wall 200B, the right wall 200C, the left wall 200D, and the rear wall 200E form an accommodation portion 200F. The accommodation portion 200F is a rectangular parallelepiped space to which the pull-out heating cooking appliance 100 is attached.

The embodiments of the disclosure are described above with reference to the drawings. However, the disclosure is not limited to the embodiments described above, and it is possible to perform the disclosure in various aspects without departing from the gist thereof. Further, various disclosures can be formed by appropriately combining a plurality of components disclosed in the embodiments described above. For example, several components may be deleted from all the components indicated in the embodiments. Furthermore, the components across different embodiments may be appropriately combined. For ease of understanding, the drawings schematically illustrate each component as a main constituent, and the thickness, length, number, spacing, and the like of each component illustrated are different from the actual thickness, length, number, spacing for convenience of drawing preparation. Further, the speed, material, shape, dimensions, and the like of each component illustrated in the embodiments described above are one example and are not particularly limited, and various modifications can be made within a range that does not substantially deviate from the configuration of the disclosure.

(1) In the present embodiment, the holding portion 180 is located on the heating cooking chamber 100A side, but the disclosure is not limited thereto. As illustrated in FIG. 3, the holding portion 180 may be attached between the left wall 1B and the left outer wall 1H.

(2) In the present embodiment, the third holding portion 181A and the fourth holding portion 181B coincide with the position P5 of the third through hole 53 and the position P6 of the fourth through hole 54 having heights different from each other, and thus the holding portion 180 is inclined and the heater 161 is inclined in accordance with the inclination of the holding portion 180. However, the disclosure is not limited thereto. For example, the position of the first holding portion 185A along the vertical direction and the position of the second holding portion 185B along the vertical direction may be different in the holding portion 180. In other words, the heater 161 is inclined in accordance with the position of the first holding portion 185A and the position of the second holding portion 185B. Then, the inclined heater 161 is held by the holding portion 180. Furthermore, the heater 161 is attached to the left wall 1B in an inclined state by fixing the left wall 1B and the holding portion 180.

INDUSTRIAL APPLICABILITY

The disclosure is usable in the field of a heating cooking device.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A heating cooking device, comprising:

a heating cooking chamber including a top wall and configured to accommodate an object to be heated;

a heater configured to heat the object; and a support portion disposed on the top wall and configured to support a part of the heater, wherein the heating cooking chamber further includes a first side wall and a second side wall facing the first side wall, the heater extends from the first side wall toward the second side wall, folds back from a side of the second side wall, and extends to the first side wall, the heater includes a first base end portion and a second base end portion separated from each other, the first base end portion and the second base end portion are disposed on the first side wall, a position of the first base end portion along a vertical direction and a position of the second base end portion along the vertical direction are different, the support portion includes a first support portion and a second support portion facing each other along the vertical direction, and includes a connection portion configured to connect the first support portion and the second support portion, the part of the heater is located in a space surrounded by the first support portion, the second support, and the connection portion, the part of the heater includes a first edge on a side directed to the first base end portion and a second edge on a side directed to the second base end portion, the heater is twisted, such that the part of the heater extends in a direction inclined to a horizontal direction, the first edge is in contact with the first support portion and apart from the second support portion by a biasing force due to twisting of the heater, and the second edge is in contact with the second support portion and apart from the first support portion by the biasing force.

2. The heating cooking device according to claim 1, wherein the part of the heater is a folded portion of the heater.

3. A heating cooking device, comprising:

a heating cooking chamber including a top wall and configured to accommodate an object to be heated;

a heater configured to heat the object; and a support portion disposed on the top wall and configured to support a part of the heater, wherein the heating cooking chamber further includes a first side wall and a second side wall facing the first side wall, the heater extends from the first side wall toward the second side wall, folds back from a side of the second side wall, and extends to the first side wall, the heater includes a first base end portion and a second base end portion separated from each other, the first base end portion and the second base end portion are disposed on the first side wall, a position of the first base end portion along a vertical direction and a position of the second base end portion along the vertical direction are different, the part of the heater is a folded portion of the heater, a holding portion is disposed along the first side wall and configured to hold the first base end portion and the second base end portion, a fixing portion is configured to fix the holding portion to the first side wall, the first base end portion includes a first held portion and a first insertion portion, the second base end portion includes a second held portion and a second insertion portion, the holding portion includes a first holding portion configured to hold the first held portion, and a second holding portion configured to hold the second held portion, the first side wall includes a first through hole through which the first insertion portion is inserted, and a second through hole through which the second insertion portion is inserted, the fixing portion includes a first fixing member configured to fix the holding portion to the first side wall at a first fixing position, a second fixing member configured to fix the holding portion to the first side wall at a second fixing position, and a third fixing member configured to fix the holding portion to the first side wall at a third fixing position, the third fixing position indicates a position in a predetermined region of the first side wall, an outer edge of the predetermined region passes through the first through hole and the second through hole, the first fixing position indicates a position on an opposite side of the third fixing position with respect to the first through hole, and the second fixing position indicates a position on an opposite side of the third fixing position with respect to the second through hole.

4. The heating cooking device according to claim 3, wherein the third fixing position is located between the first through hole and the second through hole.

* * * * *